US007466289B2

(12) United States Patent
Lin et al.

(10) Patent No.: US 7,466,289 B2
(45) Date of Patent: Dec. 16, 2008

(54) INTEGRATED MODULE OF ANTENNA AND CONNECTOR

(75) Inventors: Han-Ni Lin, Taoyuan (TW); Keh-Chang Cheng, Taoyuan (TW)

(73) Assignee: P-Two Industries Inc., Taoyuan (TW)

( * ) Notice: Subject to any disclaimer, the term of this patent is extended or adjusted under 35 U.S.C. 154(b) by 91 days.

(21) Appl. No.: 11/783,438

(22) Filed: Apr. 10, 2007

(65) Prior Publication Data

US 2008/0158079 A1 Jul. 3, 2008

(30) Foreign Application Priority Data

Sep. 21, 2006 (TW) ..... 95135076 A

(51) Int. Cl.

| | |
|---|---|
| ***H01Q 9/04*** | (2006.01) |
| ***H01Q 1/38*** | (2006.01) |
| ***H01Q 5/00*** | (2006.01) |
| ***H01Q 1/24*** | (2006.01) |
| ***H01Q 13/10*** | (2006.01) |
| ***H01Q 1/50*** | (2006.01) |

(52) U.S. Cl. ..... 343/906; 343/767; 343/702; 343/700 MS

(58) Field of Classification Search ..... 343/906, 343/702, 700 MS, 767
See application file for complete search history.

(56) References Cited

U.S. PATENT DOCUMENTS

| | | | | |
|---|---|---|---|---|
| 6,346,914 | B1 * | 2/2002 | Annamaa | 343/700 MS |
| 2006/0001571 | A1 * | 1/2006 | Sathath | 343/700 MS |
| 2007/0291525 | A1 * | 12/2007 | Tanaka et al. | 365/52 |

* cited by examiner

*Primary Examiner*—Douglas W Owens
*Assistant Examiner*—Jennifer F Chang
(74) *Attorney, Agent, or Firm*—Rosenberg, Klein & Lee

(57) ABSTRACT

An integrated module of antenna and connector has an insulative housing receiving a plurality of conductive terminals therein, a metal shell shielding the insulative housing, and a coupling device assembled on the metal shell. The metal shell is grounded and defines a slot with a particular shape. A feed-in terminal is provided on a side of the slot and includes a soldering portion and a contact portion. The soldering portion of the feed-in terminal connects with a circuit board. The coupling device contacts the contact portion of the feed-in terminal, feeding in high-frequency voltage which forms voltage difference relative to a plane of the slot. A resonant electromagnetic field is produced in the slot for working as an antenna for electromagnetic wave radiation. Thus, functions of an antenna and a connector are combined, reducing the occupied space and decreasing the cost.

17 Claims, 8 Drawing Sheets

INTEGRATED MODULE OF ANTENNA AND CONNECTOR

BACKGROUND OF THE INVENTION

1. Field of the Invention

The present invention relates to an integrated module of antenna and connector, and particularly to a module which integrates wideband antenna to a metal shell of a connector for reducing total area and thickness.

2. Related Art

It is well known that electromagnetic waves play a main role in signal transmission. Antennas are ordinarily adapted to induce and transmit electromagnetic waves. Mobile phones are popularly used and achieve long-distance communication by virtue of antennas. With combination of digital products such as computer, TV and digital camera etc., wideband environment is inevitable tendency. Besides GSM and 3G (UMTS/WCDMA), various communication technologies, for instance Bluetooth for short-distance phonic communication, Wireless LAN (WLAN) for wireless network connection, Radio Frequency Identification (RFID) for wireless radio frequency and Ultra-Wideband (UWB) for vast and high-speed data transfer, need to be combined into mobile phones. Currently antennas on the mobile phones provide not only long-distance communication but also short-distance phonic and data transfer, which equips communication technology with multiple functions in practice.

In order to reduce occupied space on the circuit board, antennas are adjusted to mount on inner walls of outer shells of mobile phones or outer shells of RF modules. However, in these ways, designs of signal feed-in and grounding connection regarding planar antennas become complicated. This makes design and manufacture more difficult, and only changes locations of the antennas, instead of diminishes the space occupied by the antennas.

SUMMARY OF THE INVENTION

Accordingly, an object of the present invention is to provide an integrated module of antenna and connector which integrates a wideband antenna to a metal shell of a connector for reducing area occupied by components thereby meeting tendency of miniature and lowering cost.

The integrated module of antenna and connector of the present invention comprises an insulative housing, a metal shell shielding the insulative housing, and a coupling device assembled on the metal shell. The insulative housing receives a plurality of conductive terminals therein. The metal shell connects with a grounding circuit of a circuit board at an appropriate location, and defines a slot with a particular shape. A feed-in terminal is provided on a side of the slot, and includes a soldering portion and a contact portion. The coupling device contacts the contact portion of the feed-in terminal, feeding in high-frequency voltage which forms voltage difference relative to a plane of the slot, thereby producing a resonant electromagnetic field in the slot for working as an antenna for electromagnetic wave radiation.

The coupling device includes a pair of insulated films and a metal strip sandwiched between the insulated films. The metal strip forms a contact surface appropriately bending for contacting the contact portion of the feeding terminal.

DESCRIPTION OF THE PREFERRED EMBODIMENTS

Figure 1:
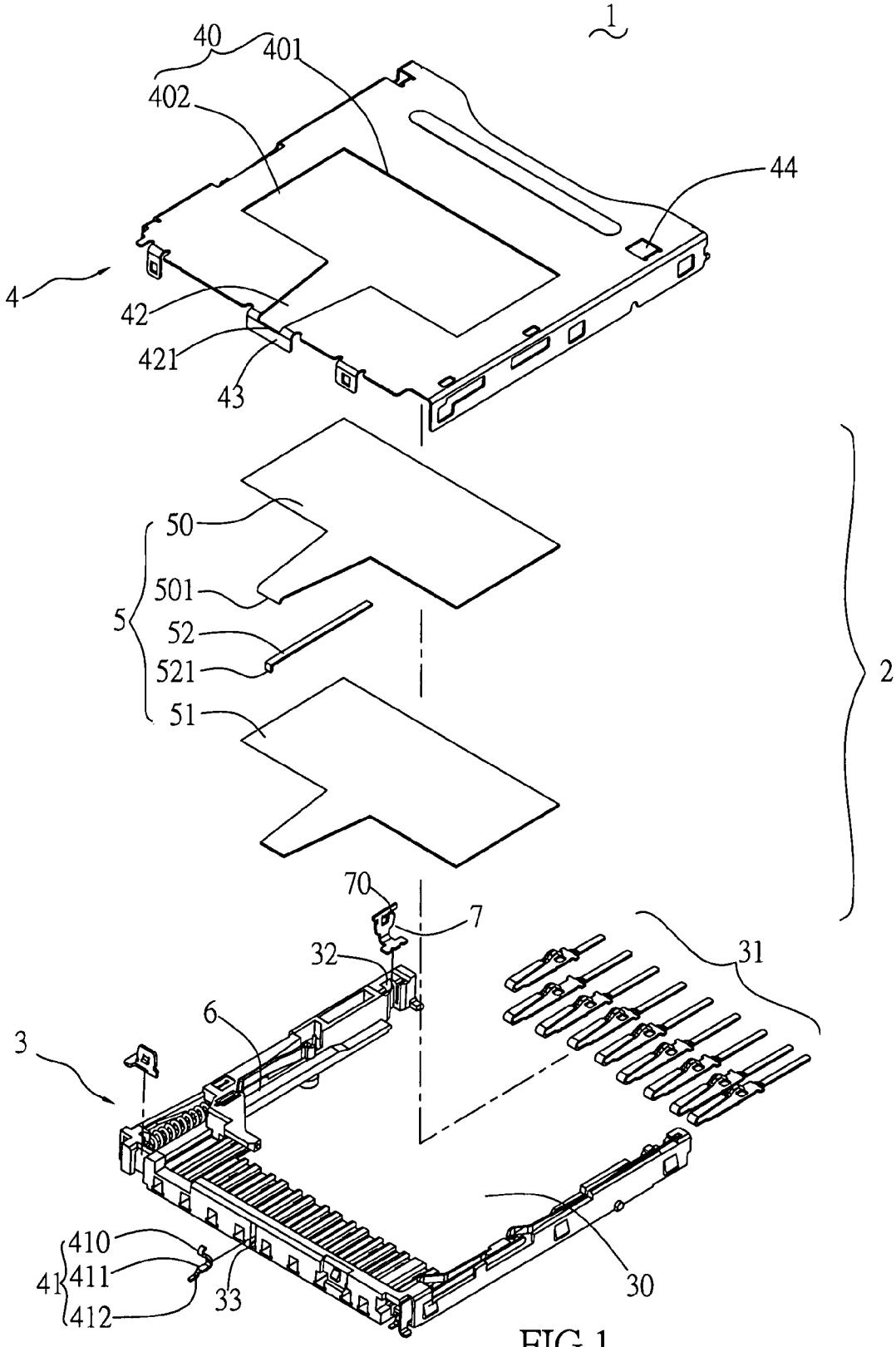
FIG. 1 is an exploded view of an integrated module of antenna and connector according to the present invention.
Figure 2:
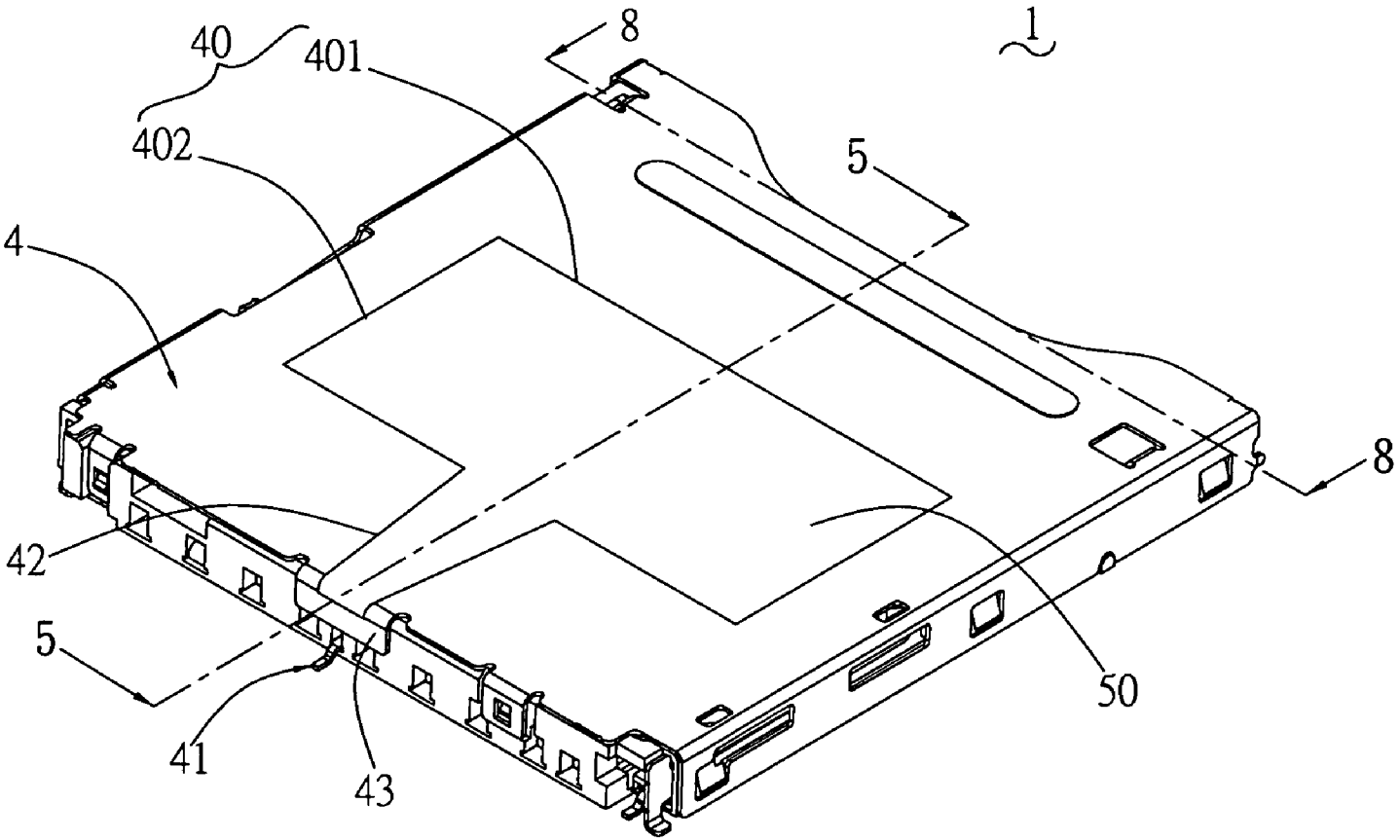
FIG. 2 is an assembled view of the integrated module of antenna and connector of FIG. 1.
Figure 3:
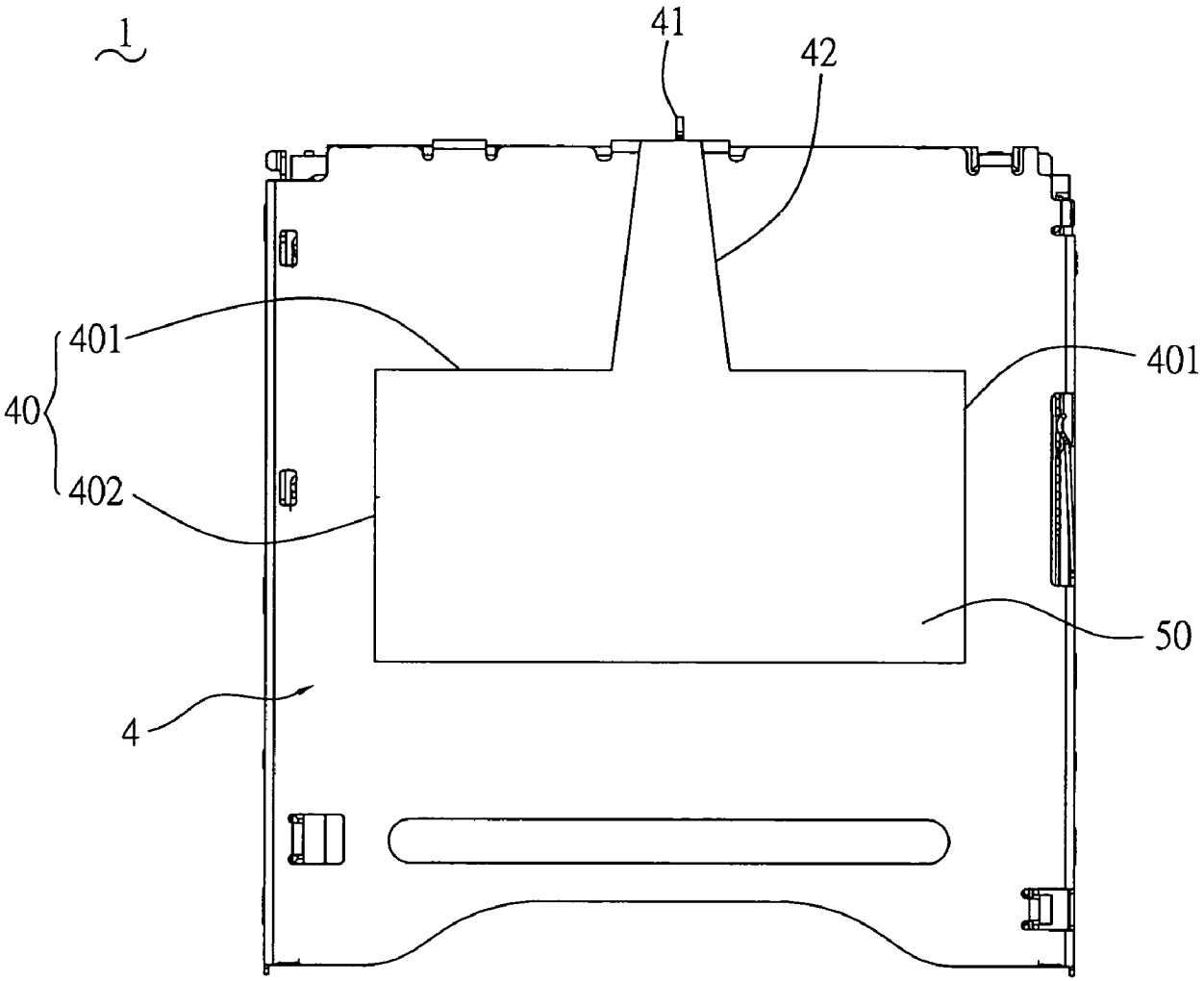
FIG. 3 is a top view of the integrated module of antenna and connector.

FIGS. 1 to 3 illustrate an integrated module of antenna and connector in accordance with the first embodiment of the present invention. The integrated module of antenna and connector is integrated with a memory card connector in this embodiment. The integrated module of antenna and connector 2 comprises an insulative housing 3, a metal shell 4 and a coupling device 5 assembled on the metal shell 4. The insulative housing 3 defines an opening 30 for receiving a memory card (not shown) and a plurality of conductive terminals 31. The integrated module of antenna and connector 2 further comprises an ejecting mechanism 6, which is well known in the art and does not need detailed description.

Figure 4:
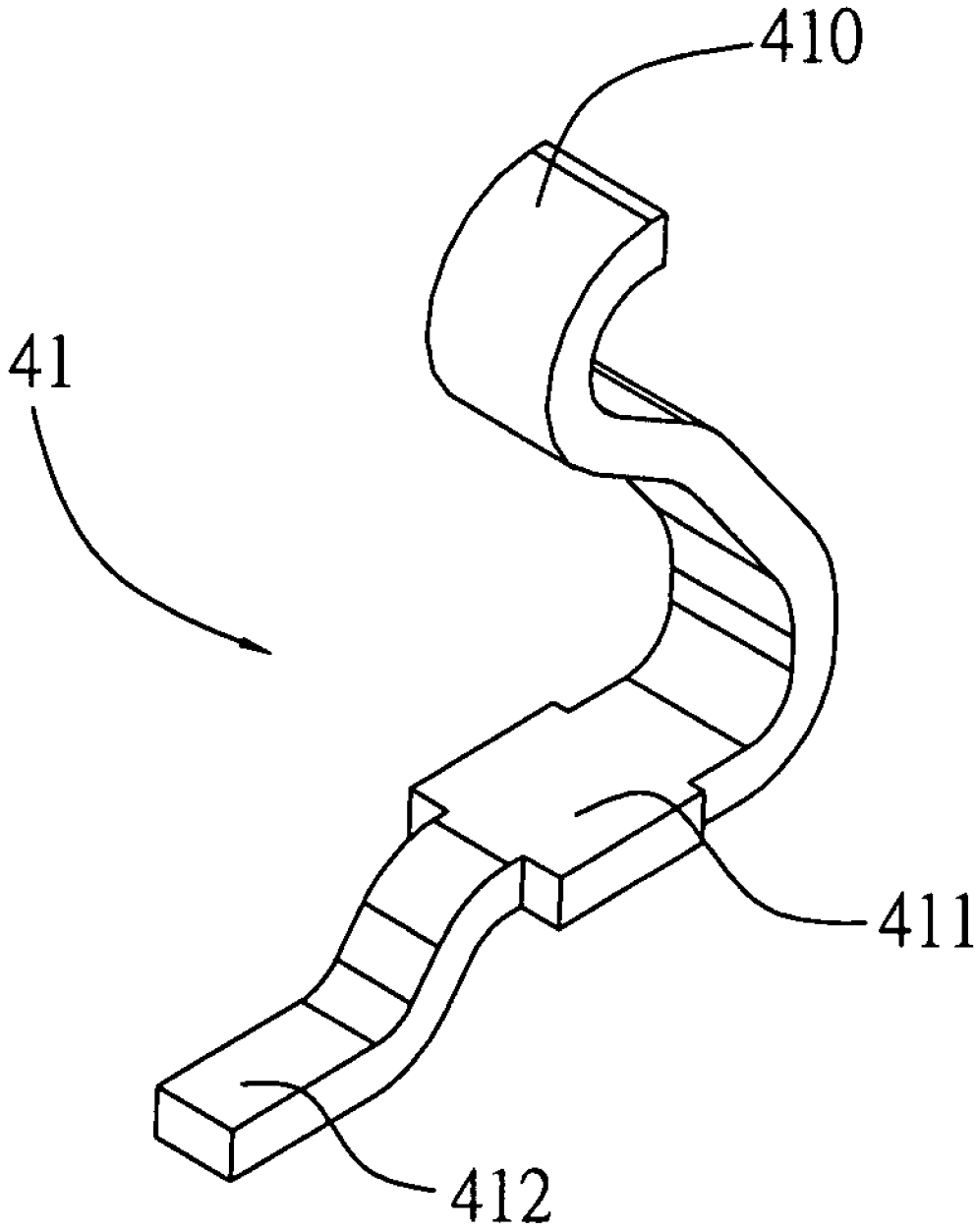
FIG. 4 is a perspective view of a feed-in terminal of the integrated module of antenna and connector.
Figure 6:
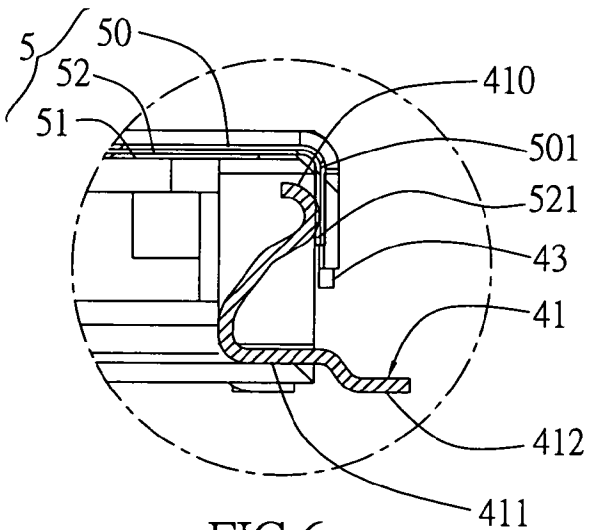
FIG. 6 is a partial and enlarged view of FIG. 5.
Figure 7:
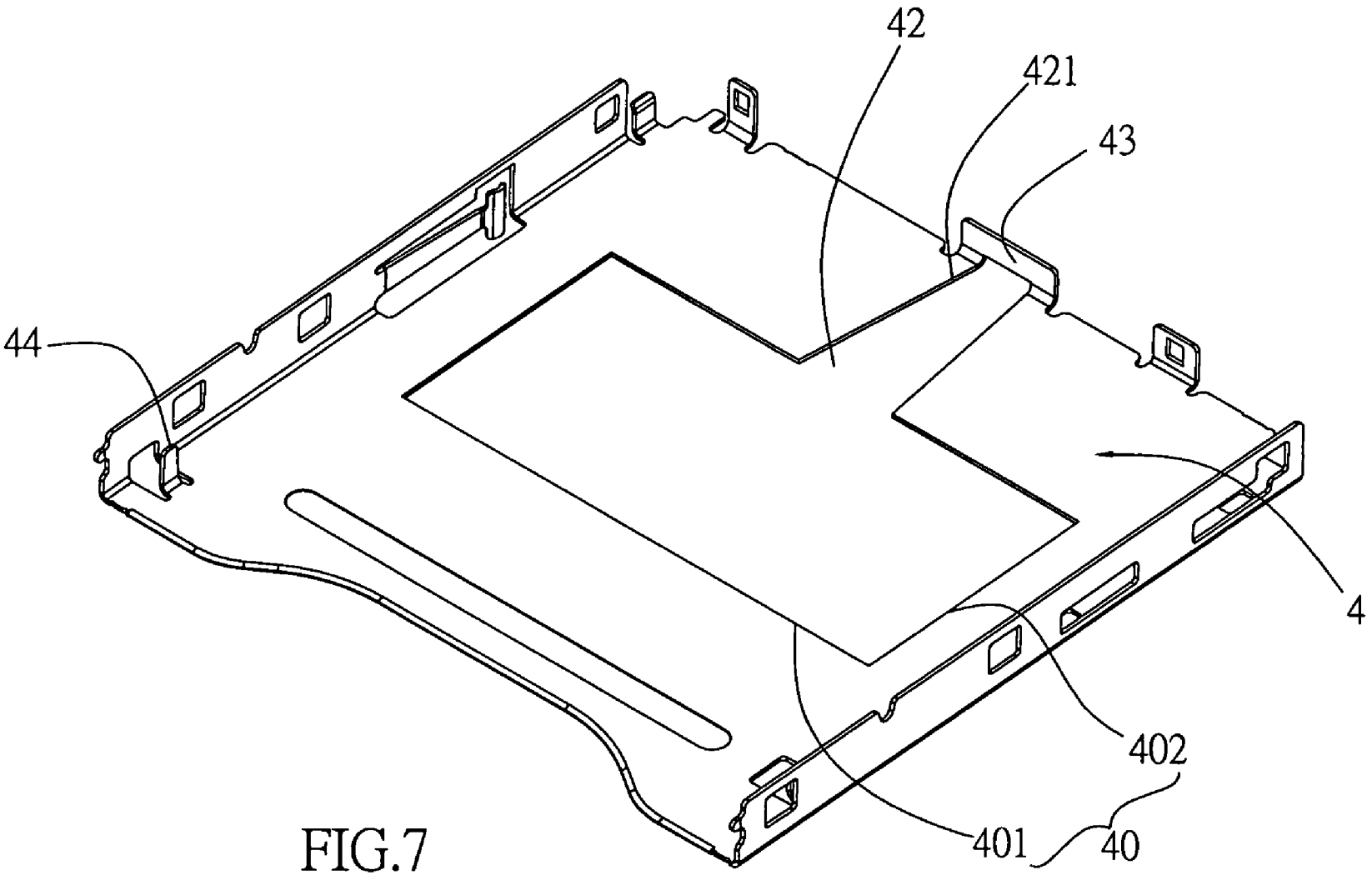
FIG. 7 is a perspective view of a metal shell of the integrated module of antenna and connector, which is viewed from a top thereof.
Figure 8:
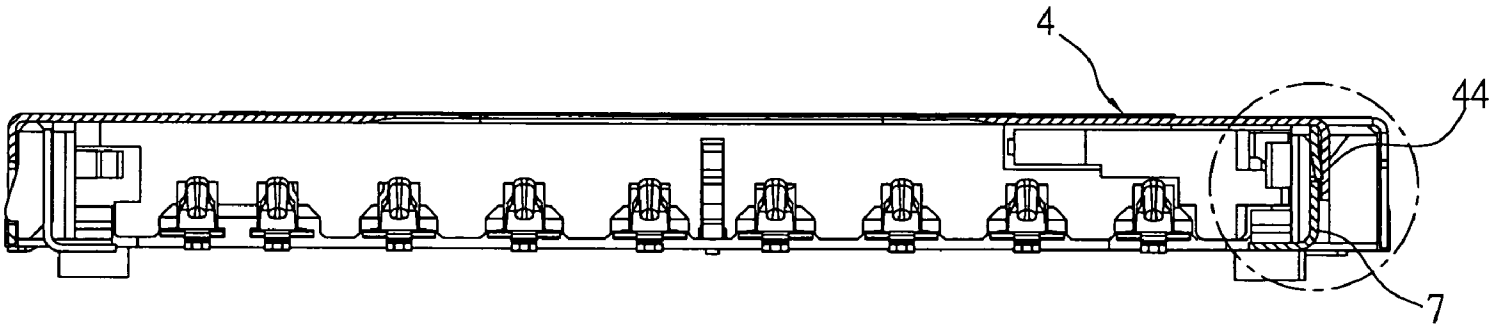
FIG. 8 is a cross-sectional view taken along the line 8-8 in FIG. 2.

The metal shell 4 shields the insulative housing 3, and defines a rectangular slot 40 in a center thereof. The slot 40 has a pair of long sides 401 and a pair of short sides 402. A feed-in terminal 41 is provided on a long side 401. Further referring to FIG. 4, the feed-in terminal 41 includes a contact portion 410, a soldering portion 412, and an interferential portion 411 formed integrally between contact portion 410 and the soldering portion 412. The soldering portion 412 appropriately bends for surface mounting to a circuit board (not shown). With reference to FIG. 6, the contact portion 410 extends from the soldering portion 412 for contacting a contact surface 521 of a metal strip 52 of a coupling device 5 in assembly. The interferential portion 411 is interferentially assembled on an assembling hole 33 of the insulative housing 3 in assembly. A slit 42 extends from a long side 401 of the slot 40 and communicates with the slot 40 for impedance matching. The slit 42 has gradually decreased width toward the feed-in terminal 41, and has a narrower portion 421 adjacent to the feed-in terminal 41 for working as input impedance matching. A connecting portion 43 depends downwardly from the metal shell 4 and adjacent to the narrower portion 421.

Figure 5:
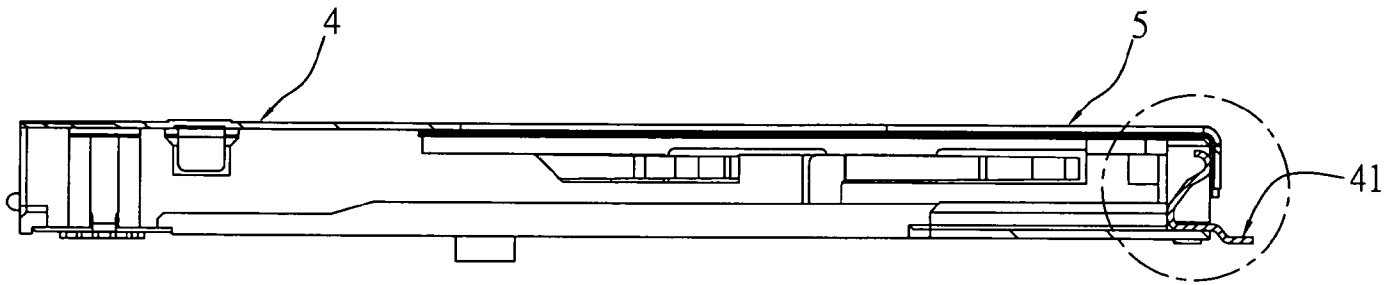
FIG. 5 is a cross-sectional view taken along the line 5-5 in FIG. 2.

Referring to FIGS. 5 and 6, the coupling device 5 comprises a pair of insulated films 50, 51 and a metal strip 52 sandwiched between the insulated films 50, 51. The insulated films 50, 51 substantially have the same shape and respectively have area slightly larger than total area of the slot 40 and the slit 42 for covering the slot 40 and the slit 42. The insulated film 50 forms a stop 501 at an end thereof for corresponding to the connecting portion 43. The metal strip 52 forms a contact surface 521 corresponding to the stop 501 and bending appropriately for contacting the feeding terminal 41. As clearly shown in FIG. 6, the metal strip 52 is capsulated by the insulated films 50, 51 except only the contact surface 521 extending beyond the insulated films 50, 51 for contacting the contact portion 410 of the feed-in terminal 41. The contact surface 521 contacts the feed-in terminal 41, forming a feed-in coupling area for feeding in high-frequency voltage, which forms voltage difference relative to a plane of the slot 40 (shown in FIG. 1). A resonant electromagnetic field is produced in the slot 40, working as an antenna for electromagnetic wave radiation.

Figure 9:
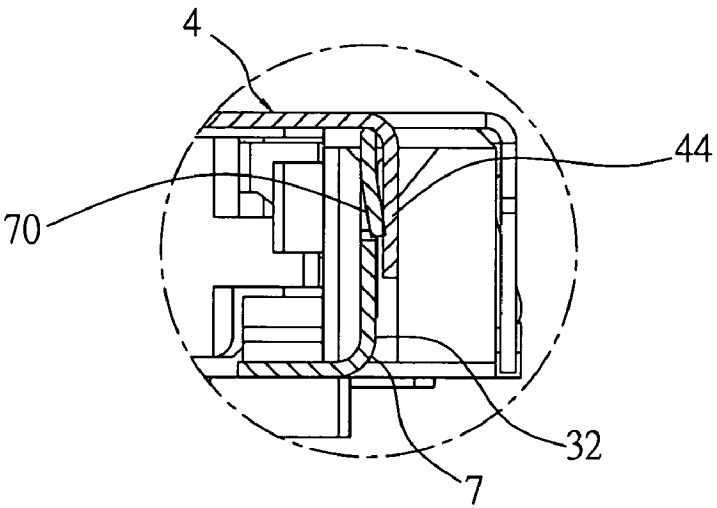
FIG. 9 is a partial and enlarged view of FIG. 8.

With Reference to FIG. 1 and FIGS. 7-9, the metal shell 4 forms a grounding tail 44 for corresponding to a grounding sheet 7 of the memory card connector 2. During assembly, as shown in FIG. 9, the grounding sheet 7 and the grounding tail 44 are assembled within a cavity 32 of the insulative housing 3. A tongue 70 of the grounding sheet 7 abuts against the grounding tail 44 for facilitating the grounding tail 44 firmly assembled on and electrically connected with a grounding circuit of the circuit board. In practice, the metal shell 4 may be directly earthed without further contacting the grounding sheet 7. The soldering portion 412 of the feed-in terminal 41 communicates with the circuit board. The contact surface 521 of the metal strip 52 contacts the contact portion 410 of the feed-in terminal 41, and feeds in high-frequency voltage to form voltage difference with respect to the plane of the slot 40. A resonant electromagnetic field is produced inside the slot 40, acting as an antenna for electromagnetic wave radiation.

Figure 10:
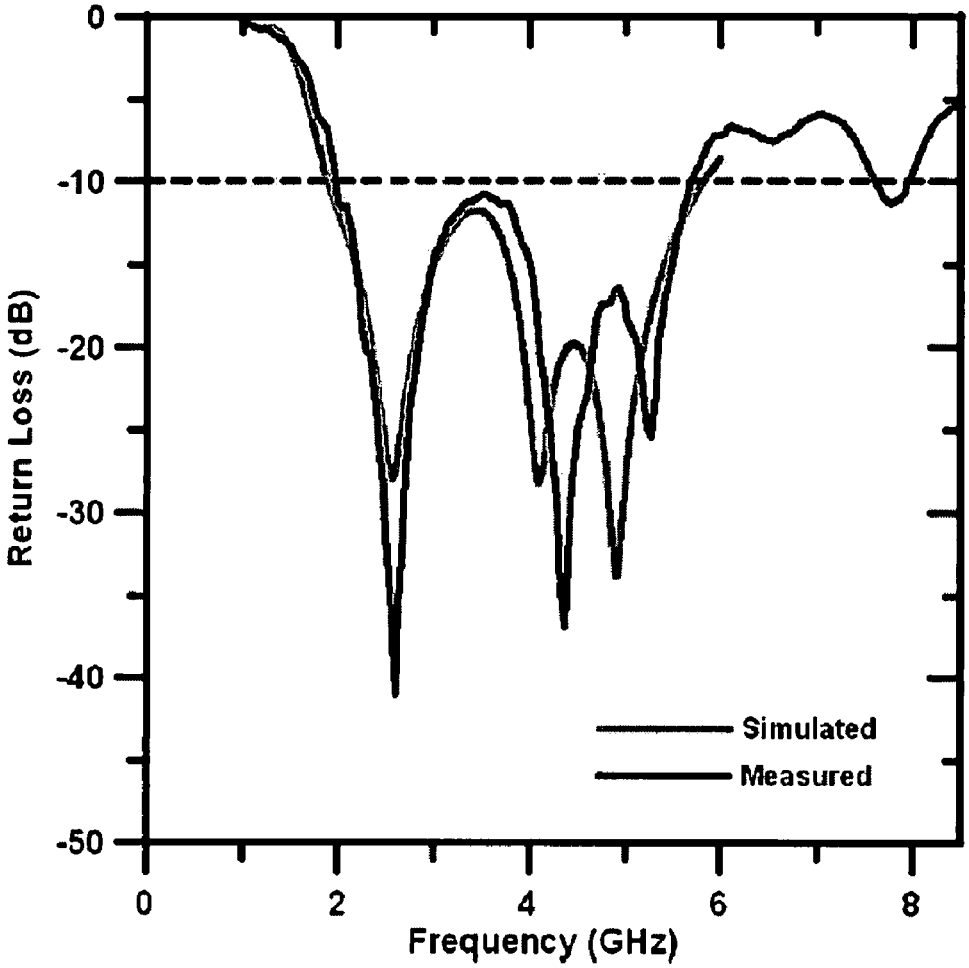
FIG. 10 is a diagram showing simulated and measured testing results of the integrated module of antenna and connector.

FIG. 10 is a diagram showing simulated and measured testing results of the integrated module of antenna and connector, wherein the slot 40 is tested. In FIG. 10, the transverse axis of the diagram represents frequency, while the longitudinal axis represents Return loss of antenna at a frequency. As an example, when the return loss is −10 dB, the antenna bandwidth is about 2.0~5.7 GHz. The slot 40 of the present invention is proved to have function of wideband antenna, and therefore is able to provide long-distance communication and short-distance phonetic and data transference.

It is proved that the integrated module of antenna and connector of the present invention can solve the problems in the art and achieve the desired effect. It is understood that the invention may be embodied in other forms without departing from the spirit thereof. For example, the memory card connector can be replaced with Electrical Card Connector, Subscriber Identity Module Card Connector (SIM Card Connector) or Input/Output Connector (I/O Connector). The present examples and embodiments are to be considered in all respects as illustrative and not restrictive, and the invention is not to be limited to the details given herein.

The invention claimed is:

1. An integrated module of antenna and connector, adapted to communicate with a circuit board, comprising:

an insulative housing receiving a plurality of conductive terminals therein;

a metal shell shielding the insulative housing, and defining a slot with a particular shape, a feed-in terminal being provided on a side of the slot and including a soldering portion and a contact portion, the metal shell connecting with a grounding circuit of the circuit board at an appropriate location; and a coupling device assembled on the metal shell, and including a pair of insulated films and a metal strip sandwiched between the insulated films, the metal strip forming a contact surface for contacting the contact portion of the feed-in terminal;

wherein the soldering portion of the feed-in terminal communicates with the circuit board, and the contact surface of the metal strip contacts the contact portion of the feed-in terminal, feeding in high-frequency voltage which forms voltage difference relative to a plane of the slot, thereby producing a resonant electromagnetic field in the slot for working as an antenna for electromagnetic wave radiation.

2. The integrated module of antenna and connector as claimed in claim 1, wherein the slot is rectangular and has a pair of long sides and a pair of short sides, and wherein a slit extends from a long side of the slot and communicates with the slot, the slit having a narrower portion adjacent to the feed-in terminal and working for input impedance matching.

3. The integrated module of antenna and connector as claimed in claim 2, wherein a connecting portion depends downwardly from the metal shell and adjacent to the narrower portion of the slit.

4. The integrated module of antenna and connector as claimed in claim 3, wherein the insulated films have the same shape and respectively have areas slightly larger than total area of the slot and the slit such that the insulated films cover the slot and the slit.

5. The integrated module of antenna and connector as claimed in claim 4, wherein one of the insulated films forms a stop at an end thereof for corresponding to the connecting portion, and wherein the contact surface of the metal strip corresponds to the stop and bends appropriately for contacting the feeding terminal.

6. The integrated module of antenna and connector as claimed in claim 1, wherein the metal shell communicates with the grounding circuit of the circuit board.

7. The integrated module of antenna and connector as claimed in claim 1, wherein the soldering portion of the feed-in terminal appropriately bends for surface mounting to the circuit board, and the contact portion extends from the soldering portion.

8. The integrated module of antenna and connector as claimed in claim 7, wherein an interferential portion is formed integrally between the contact portion and the soldering portion.

9. An integrated module of antenna and connector, adapted to communicate with a circuit board and to be assembled upon information products, such as mobile phones, for providing signal connection between a memory card and the circuit board, comprising:

an insulative housing defining an opening for receiving a memory card and a plurality of conductive terminals therein; and a metal shell shielding the insulative housing and connecting with a grounding circuit of the circuit board at an appropriate location, a slot being defined in the metal shell, a feed-in terminal being provided on a side of the slot and including a soldering portion and a contact portion, a slit extending from a side of the slot for corresponding to the feed-in terminal;

wherein the feed-in terminal communicates with the metal shell, feeding in high-frequency voltage which produces a resonant electromagnetic field inside the slot for working as an antenna for electromagnetic wave radiation.

10. The integrated module of antenna and connector as claimed in claim 9, wherein the slit has a narrower portion adjacent to the feed-in terminal.

11. The integrated module of antenna and connector as claimed in claim 9, wherein a connecting portion depends downwardly from the metal shell and adjacent to the narrower portion of the slit.

12. The integrated module of antenna and connector as claimed in claim 9, wherein the metal shell communicates with the grounding circuit of the circuit board.

13. The integrated module of antenna and connector as claimed in claim 9, wherein the soldering portion of the feed-in terminal appropriately bends for surface mounting to the circuit board, and the contact portion extends from the soldering portion.

14. The integrated module of antenna and connector as claimed in claim 9, wherein an interferential portion is formed integrally between the contact portion and the soldering portion.

15. The integrated module of antenna and connector as claimed in claim 9, further comprising a coupling device assembled on the metal shell, the coupling device including a pair of insulated films and a metal strip sandwiched between the insulated films, the metal strip forming a contact surface for contacting the contact portion of the feeding terminal.

16. The integrated module of antenna and connector as claimed in claim 15, wherein the insulated films have the same shape and respectively have area slightly larger than total area of the slot and the slit for covering the slot and the slit.

17. The integrated module of antenna and connector as claimed in claim 16, wherein one of the insulated films forms a stop at an end thereof for corresponding to the connecting portion, and wherein the contact surface of the metal strip corresponds to the stop and bends appropriately for contacting the feeding terminal.

* * * * *